US005601186A

United States Patent [19]

Van Hine et al.

[11] Patent Number: 5,601,186

[45] Date of Patent: Feb. 11, 1997

[54] TUB CARRIER

[75] Inventors: Neal Van Hine, Clifton; Frederick Naumann, Old Tappan, both of N.J.

[73] Assignee: Riverwood International Corporation, Atlanta, Ga.

[21] Appl. No.: 554,955

[22] Filed: Nov. 13, 1995

[51] Int. Cl.[6] ..... B65D 71/40

[52] U.S. Cl. ..... 206/141; 206/153; 206/427

[58] Field of Search ..... 206/141, 145, 206/147, 148, 150–154, 156–159, 161, 192, 427, 430, 431, 434

[56] References Cited

U.S. PATENT DOCUMENTS

| | | | |
|---|---|---|---|
| 3,166,190 | 1/1965 | Conrades | 206/152 |
| 3,756,394 | 9/1973 | Huault | 206/431 |
| 4,703,847 | 11/1987 | Oliff | 206/434 |
| 4,703,856 | 11/1987 | Chaussadas | 206/151 |
| 5,139,147 | 8/1992 | Sutherland | 206/147 |
| 5,163,548 | 11/1992 | Domansky | 206/434 |

FOREIGN PATENT DOCUMENTS

| | | | |
|---|---|---|---|
| 1295518 | 11/1972 | United Kingdom | 206/431 |

*Primary Examiner*—Jimmy G. Foster

[57] ABSTRACT

A package containing food tubs having connecting flanges. The flanges are angled at the corners so that an opening is formed between the flanges of four adjacent tubs. A carrier includes slots in side panels through which adjacent tub flanges extend and a finger hole in the top panel overlying the opening between the flanges. This enables the package to be lifted from beneath the flanges adjacent the finger hole.

4 Claims, 2 Drawing Sheets

TUB CARRIER

FIELD OF THE INVENTION

This invention relates to carriers for flanged articles. More particularly, it relates to a carrier for a plurality of connected flanged tubs.

BACKGROUND OF THE INVENTION

Pudding and other soft solid food products are commonly sold in plastic tubs. Access to the contents of the tubs is normally provided by a removable covering secured to flanges extending out from the top edges of the tubs. Carriers designed to package one or more of such tubs are typically of the wrap-around type, having slots in the side panels for receiving the tub flanges. A handle is sometimes included in the carrier, especially if the carrier contains two rows of tubs, in which case the handle conventionally takes the form of finger openings in the top panel. The openings are located between the tubs similar to the manner in which finger openings are provided in wrap-around carriers containing beverage cans, so that a finger can be inserted through the opening and engage the underside of the top panel when lifting the carrier.

Carriers of this type have certain drawbacks, however, when employed to package tubs. The amount of material necessary to produce a wrap-around carrier tends to make the cost of the carrier relatively high in relation to the value of the product. Also, the common practice of supplying tubs in groups of four or more units connected at their flanges prevents the use of finger holes as a carrier handle because the connected flanges would obstruct entry into the interior of the carrier.

It would therefore be desirable to package multiple units of connected tubs in a carrier which includes a handle but does not require the amount of stock required for a wrap-around carrier.

BRIEF SUMMARY OF THE INVENTION

The invention is a package containing at least four similar flanged articles arranged in two rows, with the flanges of adjacent articles being connected to each other. The flanges are shaped so that there is an opening between the flanges of the four articles. The package also includes a carrier having a top panel and opposite foldably connected side panel flaps. The side panel flaps include slots through which portions of adjacent flanges of adjacent articles extend and the top panel contains a finger hole substantially aligned with the opening between the flanges of the articles. This allows the package to be lifted by the underside of the article flanges. Preferably, the top panel includes a foldably connected tab covering the finger hole so that when the finger of a user pushes the tab down into the package, it folds beneath the underside of the adjacent flanges.

An example of the type of articles especially adapted to be packaged in this manner are food tubs the flanges of which are connected to each other along readily broken lines. The carrier is inexpensive and can readily be applied to the tubs to be packaged.

The above and other aspects and benefits of the invention will readily be apparent from the more detailed description of the preferred embodiment of the invention which follows.

DETAILED DESCRIPTION OF THE PREFERRED EMBODIMENT

Figure 1:
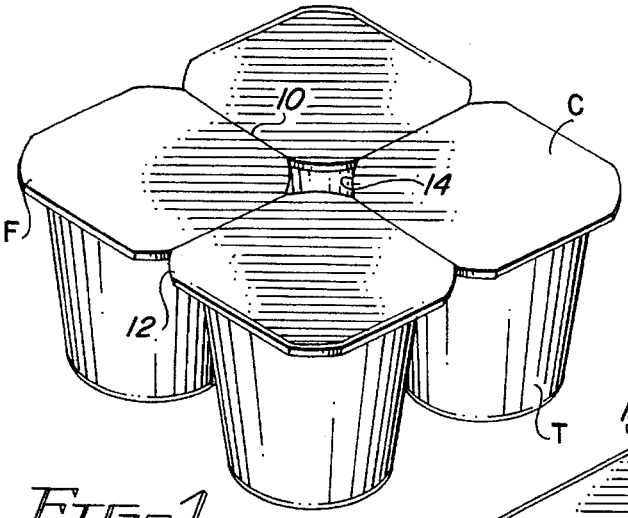
FIG. 1 is a pictorial view of four connected food tubs of the type adapted to be packaged in accordance with the invention.

Referring to FIG. 1, food tubs T include flanges F which extend out from the upper circumference of the tubs. A cover C of foil or other flexible impervious material is adhered to the flanges so that a portion of it can readily be grasped and peeled off to expose the contents of the tub. The flanges of each tub have straight edge portions which are connected to adjacent tub flanges along easily broken lines 10 to enable individual tubs to be removed from the group. The structure described thus far is conventional. The flanges in this case, however, have rounded corners which result in notches 12 between adjacent tub flanges in the perimeter of the connected flanges and a central opening 14 between the four adjacent tub flanges.

Figure 2:
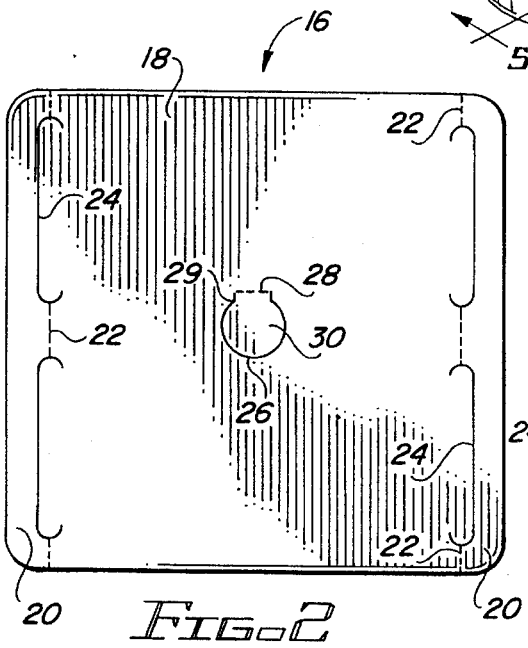
FIG. 2 is a plan view of a blank for forming a carrier used to package the food tubs of FIG. 1.

Referring to FIG. 2, a blank 16 is shown for forming a carrier for the connected tubs of FIG. 1. The blank, which preferably is formed of paperboard or other material with comparable flexibility and strength, is of generally rectangular configuration and is comprised of a central top panel section 18 and oppositely located side panel flaps 20. Each flap is connected to the central section 18 by a fold line 22 which is interrupted by slits 24. The slits, which are adapted to form slots in the side panels of a carrier for receiving the flanges of packaged tubs, preferably terminate in arcuate ends to prevent tearing at the juncture between the slits and the fold line 22. A curved slit 26, the ends of which are connected to fold line 28 by short parallel slits 29, forms a tab or flap 30 covering a centrally located finger hole. The dimensions of the blank are coordinated with the dimensions of the tubs so that the distance between opposite slits 24 is substantially equal to, but no less than, the combined width of two connected tubs, and the length of the straight portion of the slits is at least equal to the length of the straight edge of the flanges.

Figure 3:
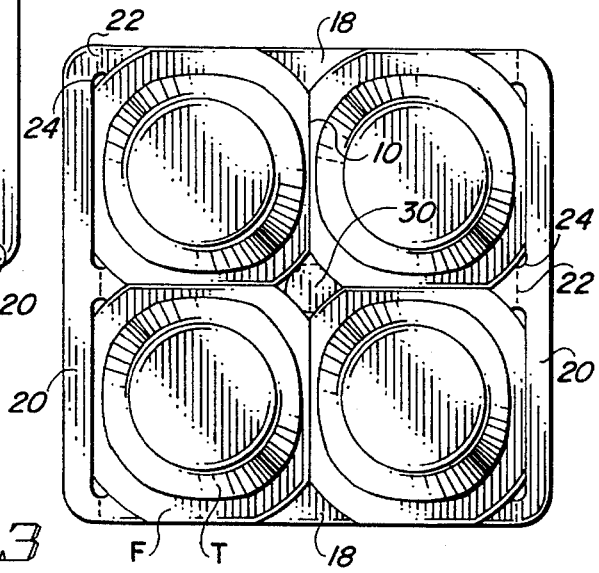
FIG. 3 is a bottom plan view of the blank of FIG. 2 in position on the food tubs to be folded into carrier form.

To form a package of the four connected tubs of FIG. 1, the blank is placed on top of the tubs so that the slits 24 are aligned with the straight edge portions of the outer flanges of the connected tubs. The finger hole tab 30 overlies the central opening 14 between the corner flanges of the connected tubs. This initial arrangement is illustrated by the bottom plan view of FIG. 3. It can be seen that the tub flanges do not interfere with the fold lines 22 of the blank. Although the finger hole tab 30 is partly covered by the adjacent flange corners, the tab fold line 28 and the neck formed by the parallel slits 29 are not.

Figure 4:
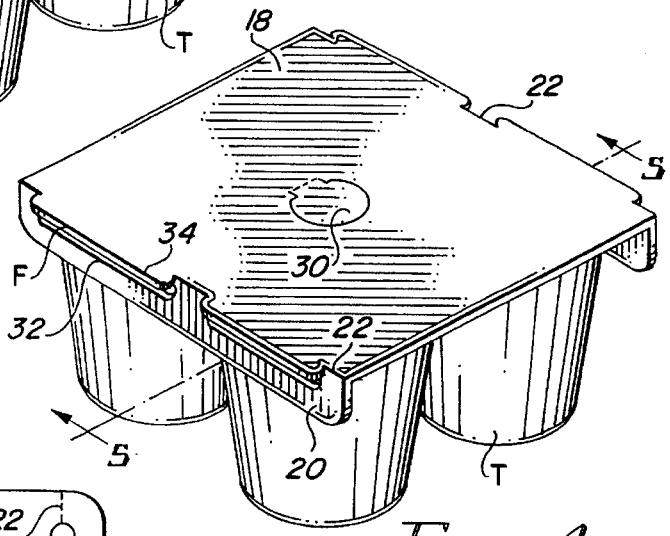
FIG. 4 is a pictorial view of a package formed by the carrier of the invention.
Figure 5:
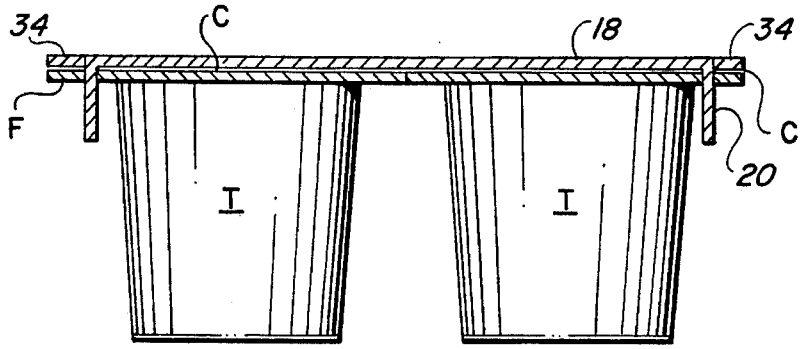
FIG. 5 is a transverse sectional view taken on line 5—5 of FIG. 4.

The side panel flaps are then folded down about the fold lines 22 to form the package shown in FIG. 4. Slots 32 formed in the side panels from the slits 24 receive the adjacent flange edge portions of associated tubs, with the resulting tabs 34 in the top panel 18 extending out to cover the flanges. These relationships can also be seen in the sectional view of FIG. 5.

Figure 6:
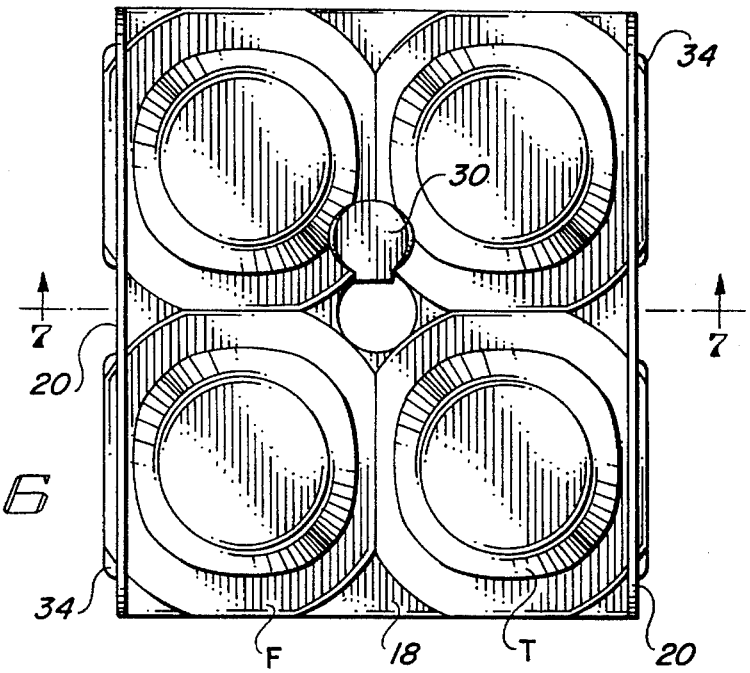
FIG. 6 is a bottom plan view of the package of FIG. 4 after the finger hole tab has been folded under.
Figure 7:
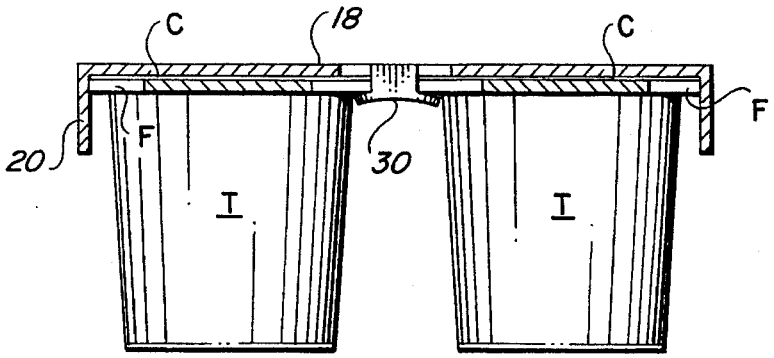
FIG. 7 is a transverse sectional view taken on line 7—7 of FIG. 6.

The underside of the package, after the tab has been actuated, is illustrated in FIG. 6. The tab arrangement is also shown in the sectional view of FIG. 7. It can be seen that when the finger hole tab 30 is pushed down and folded under the carrier about the fold line 28 it is free to do so since the fold line and the neck portion of the tab are not blocked by the tub structure. Even though portions of the tab may overlie portions of adjacent tub flanges, the flexibility of the tab allows it flex past the flange structure. The tab is shaped so that it fits between the bodies of adjacent tubs, thereby allowing it to be folded up against the underside of the adjacent tub flanges. When a person lifts the package by the finger hole, the finger of the person lifts up against the underside of the adjacent tub flanges, engaging the tab 30 while the tab engages the flanges. The tab cushions the finger against the edges of the flanges and facilitates lifting. It also provides for an unbroken expanse of the top panel prior to being actuated, which allows printing or other indicia to be provided on the carrier. The engagement of the tub flanges at the ends of the carrier slots prevents the carrier from being dislodged from the tubs prior to the folding of the finger hole tab.

Although the invention has been described in connection with four connected tubs, it is applicable as well to packages containing more than four tubs. For example, two additional tubs could be added to form an additional finger hole opening where the corners of the two added tubs and the two adjacent tubs meet. In such an arrangement the carrier would be provided with two finger hole tabs overlying the two openings between the connected tubs.

Also, the formation of the notches between adjacent tub flanges need not be limited to rounding the corners of the flanges. The same result can be achieved by simply angling the corners by means of straight edges. Regardless of whether the corners are angled by straight or curved edges, in either case the finger hole tab is shaped so as not to be obstructed by the flanges when the tab is folded under the flanges. Although not illustrated, the carrier may be provided with a notch at one or both ends designed to be aligned with the notches between tub flanges as a means for assuring that the carrier is properly placed on the tubs before the side panel flaps are folded down.

It will now be apparent that the invention provides a very economical carrier for food tubs which does not require a bottom panel, yet provides for the package to be securely lifted and carried without risk of the carrier failing. It is contemplated that the invention need not necessarily be limited to all the specific details described in connection with the preferred embodiment, but that changes to certain features of the preferred embodiment which do not alter the overall basic function and concept of the invention may be made without departing from the spirit and scope of the invention as defined in the appended claims.

What is claimed is:

1. A package, comprising:

at least four similar articles, each article having a top portion and a flange extending outwardly from the top portion;

the articles being arranged in two rows, with the flanges of adjacent articles being connected to each other;

the flanges being shaped so that there is an opening between adjacent flanges of the four articles;

a carrier having a top panel and opposite side panel flaps connected to the top panel along fold lines;

the side panel flaps including slots through which portions of adjacent flanges of adjacent articles extend;

the top panel containing a finger hole substantially aligned with the opening between the adjacent flanges of the articles;

the top panel including a tab covering the finger hole; and the tab being connected to the top panel by a fold line;

the tab being of such size and shape with respect to the size and shape of the finger hole that when the package is lifted by the finger hole the tab can be folded down through the opening between adjacent flanges of the four articles and up against the underside of the adjacent flanges of two of the adjacent articles.

2. A package as defined in claim 1, wherein the flange of each article extends along four substantially straight edges, opposite flange edges of each article being substantially parallel, each flange edge of each article being connected to an adjacent edge thereof by an angled edge whereby a space is created between adjacent angled edges of the articles, said space comprising the opening between the articles.

3. A package as defined in claim 2, wherein the fold line connecting the tab to the top panel extends between adjacent angled edges of the opening between the articles.

4. A package as defined in claim 1 wherein the top panel includes extensions covering the portions of the flanges extending through the slots in the side panel flaps.

* * * * *